US005607004A

United States Patent [19]

Cope

[11] Patent Number: 5,607,004

[45] Date of Patent: Mar. 4, 1997

[54] SELF-SUPPORTING FUNNEL ASSEMBLY AND DRIP CATCHER

[76] Inventor: Eddie W. Cope, 6372 Sulphur Ridge Rd., Bloomington Springs, Tenn. 38545-5673

[21] Appl. No.: 501,558

[22] Filed: Jul. 12, 1995

[51] Int. Cl.[6] ..... B67C 11/00

[52] U.S. Cl. ..... 141/340; 141/331; 141/383; 248/94

[58] Field of Search ..... 141/98, 331, 337, 141/338, 340–342, 383, 386, 385, 375, 364–366, 86, 88, 106, 332; 184/1.5, 105.1; 248/94

[56] References Cited

U.S. PATENT DOCUMENTS

| | | | |
|---|---|---|---|
| 192,348 | 6/1877 | Preston | 141/341 X |
| 425,312 | 4/1890 | Field | 141/340 X |
| 556,055 | 3/1896 | Haslewood | 248/94 |
| 685,607 | 10/1901 | Hoffman | 248/94 |
| 944,914 | 12/1909 | Rugg | 141/340 |
| 998,352 | 7/1911 | Kublin | 141/340 X |
| 1,213,743 | 1/1917 | Carson | 248/94 |
| 1,317,027 | 9/1919 | McLeod | 248/94 |
| 1,497,048 | 6/1924 | Vodoz | 220/86.2 |
| 1,587,493 | 6/1926 | Bower | 248/94 |
| 2,112,944 | 4/1938 | Wolcott | 248/94 X |
| 2,517,759 | 8/1950 | Bentzen | 141/340 |
| 3,860,048 | 1/1975 | White | 141/375 |
| 3,861,284 | 1/1975 | Costello | 99/321 |
| 4,157,003 | 6/1979 | Kamphaus | 53/572 |
| 4,207,933 | 6/1980 | Howson | 141/106 |
| 4,789,017 | 12/1988 | Panasewicz et al. | 141/342 |
| 4,896,746 | 1/1990 | Desjardins | 184/92 |
| 5,222,534 | 6/1993 | Wilkinson, Jr. | 141/88 |
| 5,241,753 | 9/1993 | Lalevee, Sr. | 33/726 |
| 5,265,654 | 11/1993 | Larsen . | |
| 5,385,180 | 1/1995 | Wittman | 141/340 |

FOREIGN PATENT DOCUMENTS

| | | | |
|---|---|---|---|
| 1277502 | 3/1962 | France . | |
| 1327893 | 9/1963 | France . | |
| 20122 | 9/1912 | United Kingdom | 248/94 |
| 1223996 | 3/1971 | United Kingdom . | |

*Primary Examiner*—J. Casimer Jacyna
*Attorney, Agent, or Firm*—Richard C. Litman

[57] ABSTRACT

A self-supporting funnel assembly and drip catcher for selective use in applications in which a user desires to free both the user's hands from holding the funnel in position and desires to prevent spillage of the funnelled fluid during and after use. The funnel is made up of a wider conical portion, the mouth of the funnel, and a narrower portion, the spout of the funnel; a base housing defining several openings; generally L-shaped clamping members, each having a vertical component projecting below the base housing and a horizontal component; and a springing mechanism, operably connected to each clamping member and the base housing. The funnel components so that a horizontal component of the clamping members appear through the side of the base housing as push-buttons, which may be simultaneously compressed with the thumb and forefinger. The springing mechanism, being housed within the base, resists this compressive action, but allows each clamping member to be brought into close relationship to one another temporarily. A vertical component of the clamping members may thus be inserted into an opening. Upon release of the push-buttons, the springing mechanism decompresses the clamping members against the walls of the opening. Thus, the invention may be positioned in an upright position regardless of the horizontal orientation of the opening and secured in place. A second embodiment of the inventive funnel is also described with an externally configured springing mechanism and connecting ring from which the clamping members depend.

7 Claims, 3 Drawing Sheets

SELF-SUPPORTING FUNNEL ASSEMBLY AND DRIP CATCHER

BACKGROUND OF THE INVENTION

1. Field of the Invention

The present invention relates to a self-supporting funnel assembly and drip catcher for selective applications in which a user desires to free both the user's hands from holding the funnel in position and desires to prevent spillage of the funnelled fluid during and after use.

2. Description of Prior Art

Using a funnel can be a messy, wasteful, environmentally polluting, and sometimes annoying, experience. Anyone ever having filled an engine crankcase with oil can point to numerous disadvantages associated with using an ordinary funnel. Funnels require at least one hand to hold them in an upright position for its mouth to accept the oil. Moreover, a user is tempted to lay an ordinary funnel in contact with internal engine components, which tends to block the exit of the funnel, so that upon pouring the oil into the funnel, the oil tends to back up and upon reaching a certain level within the funnel mouth, suddenly causes the funnel to tip, dumping oil over the outer surface of the crankcase. Eventually this oil will either spill onto the ground or burn off the engine contributing to environmental pollution. Moreover, the contact of the funnel tip with the internal components of the engine risks debris entering the crankcase and potentially harming the engine. Hence, a need exists for a stable funnel which can be used to prevent spillage of a motor fluid and avoid contact of the spout with the vehicle.

Furthermore, in the segment of the automotive service industry catering quick lubrication and oil changes to the consumer, speed is of the essence. Freedom by a mechanic to move about and perform multiple services on one or more vehicles saves time, and ultimately money, for such a business. Therefore, a need exists for a quick-fill and hands-free funnel which will securely remain in place over a fill port.

Moreover, the automotive service industry is faced with the costs of disposing environmental pollutants and protecting the environment from spillage. These costs may include disposal of clean-up material or waste oil. Therefore, saving these costs may be accomplished by avoiding clean-up and using less motor fluids. Therefore, a need exists for a funnel which can be stored on a drip catcher whereby the un-used oil can be saved and waste disposal limited.

Despite the existence of these needs, the prior art fails to address them. U.S. Pat. No. 685,607 issued Oct. 29, 1901 to J. R. & M. P. Hoffman describes a funnel holder for supporting funnels over cask bung-holes, made up of a support, preferably in the shape of a ring, from which depend clamping-arms and rests. The clamping-arms are preferably made of spring steel. The arms bend outwardly from lower inwardly-bent ends to form hooks adapted to engage the walls of a bung-hole. However, the '607 invention teaches away from the intended purposes of the present invention. First, the range of different size bung-hole walls accommodated by the '607 invention is limited to the range of resilience of the spring metal, and multiple sizes of clamping arms and supports are necessary to accommodate various size holes. Also, spring metal is an inappropriate material for use with an engine fill port because of the dangers of metal debris entering the crankcase. Moreover, the support is independent of the funnel, which causes the funnel to balance freely on the support. In the event that the frame is positioned over a hole not positioned in a horizontal plane, the frame causes the funnel to improperly seat on the frame, or be improperly positioned over the hole, which may result in spillage.

Although U.S. Pat. No. 5,385,180 issued Jan. 31, 1995 to Wittman describes a spill inhibiting funnel, it has stepped fins and blades extending from the outer and inner surfaces of a tapered funnel body. The fins allow the funnel to be variably positioned with respect to a receiving container's opening to prevent spills. The stepped blades allow a pouring container to be securely placed inside the funnel and remain there in an inverted position. However, the described structure is unrelated to the present invention.

Other inventions have the disadvantage of requiring a generally flat surface for their use. For example, U.S. Pat. No. 556,055 issued Mar. 10, 1896 to Haslewood describes a funnel holder having a frame for the insertion of a container, furnished with two or more legs projecting upward from a weighted base, which legs terminate in a light frame suitable for supporting a funnel. The invention is designated for use as "a spare hand"; however, the base is intended for a flat surface on which both the container and the funnel holder must rest. Similar problems accompany the invention described by U.S. Pat. No. 944,914 issued Dec. 28, 1909 to Rugg, a funnel with a simple fixed-support attached thereto.

Other funnels used in conjunction with motor fluids are also described in the prior art. For example, U.S. Pat. No. 1,497,048 issued Jun. 10, 1924 to Vodoz describes a folding funnel and strainer associated with a radiator filler cap. U.S. Pat. No. 4,789,017 issued Dec. 6, 1988 to Panasewicz et al. describes a combination funnel and drip catcher for storage of the funnel. The funnel and drip catcher are separate components which engage a wall mount. The funnel mouth is capable of accepting and puncturing a can of automotive fluid for use. However, no features for free-standing support of the funnel are described. U.S. Pat. No. 4,896,746 issued Jan. 30, 1990 to Desjardins describes a covered storage funnel for retaining an oil and gasoline mixture and dispensing it into a engine or tank, engaging the fill port by a plate and washer assembly. Great Britain Patent Specification No. 1,223,996 published Mar. 3, 1971 describes a flexible funnel which snaps onto an oil can. However, each of these funnels attempt to fulfill purposes, and describe structures, unrelated to the present invention.

Finally, other funnels designed for use in specific applications are found in the prior art. U.S. Pat. No. 5,265,654 issued Nov. 30, 1993 to Larsen describes a dosing apparatus for providing an accurate filling weight of a flowable food product. French Brevet D'Invention No. 1,277,502 dated Mar. 28, 1962 describes a funnel used for filling milk containers. French Brevet D'Invention No. 1,327,893 dated Sep. 6, 1963 describes a funnel adapted to attach to a container and having a removable filter. Again, each of these funnels attempt to fulfill purposes, and describe structures, unrelated to the present invention.

None of the above inventions and patents, taken either singly or in combination, is seen to describe the instant invention as claimed.

SUMMARY OF THE INVENTION

The present invention relates to a self-supporting funnel assembly and drip catcher for selective use in applications in which a user desires to free both the user's hands from holding the funnel in position and desires to prevent spillage of the funnelled fluid during and after use.

In the preferred embodiment, the invention is made up of a wider conical portion, defining a mouth of the funnel at its upper end; a narrower portion, defining a spout of the funnel at its lower end; a base housing, which may be integrally molded into the spout at its lower end, and defining a plurality of openings; generally L-shaped clamping members, each having a vertical component protruding below the base housing and a horizontal component horizontally moveable and protruding through an opening located in the side of the base housing; and a springing mechanism, operably connected to each clamping member and the base housing. The spout and mouth are permanently joined in communication with one another as a funnel; however, the base housing defines an enlarged base at the lower end of the funnel encompasing the spout. The base housing further may be cylindrical with a horizontal surface adapted to fit onto common engine fill ports. The clamping members appear through the side of the base housing as push-buttons, which push-buttons may be simultaneously compressed with the thumb and forefinger. The springing mechanism, being housed within the base, resists this compressive action, but allows each clamping member to be brought into close relationship to one another temporarily. The clamping members may thus be inserted into a fill port or other opening. Upon release of the push-buttons, the springing mechanism decompresses and forces the vertical components of the clamping members against the walls of the opening. Thus, the invention may be positioned in an upright position regardless of the horizontal orientation of the opening and secured in place.

Although numerous springing devices exist in the prior art which can be adapted to the present invention, in the preferred embodiment, the springing mechanism is preferably an assembly made up of an elongated and generally cylindrically-shaped coiled spring having a longitudinal axis and a support rail having a first end and a second end. The support rail is positioned within the cylinder defined by the spring so that the spring is generally centered upon the rail. The support rail is slightly longer than the spring. This configuration allows the assembly to be permanently affixed within the walls of the base housing by each end of the support rail.

The L-shaped clamping members are opposingly set to each other so that a tab extending from the horizontal component of each clamping member engages one of the two terminal ends of the spring. Thus, when the push-button is compressed, the tab transmits the compressive force to the spring. The housing is dimensioned and configured to permanently retain the springing mechanism and allow the horizontal component to ride inwardly within the base housing. The vertical components of the clamping members are thus brought into near relationship with one another. The vertical components may be dimensioned and configured to provide a gripping surface appropriate to the funnel's intended uses.

Although the preferred embodiment of the self-supporting funnel assembly is shown integrally combined with a funnel, alternatively, the self-supporting funnel assembly may be separable from the funnel. Thus the preferred embodiment may also be employed as a retrofit device for existing funnels.

A second embodiment of the inventive funnel is also described with an externally configured springing mechanism and collar from which the clamping members pivotally depend. The second embodiment employs a torsion spring as the springing mechanism, which allows an predetermined angle of outward extension of the clamping member from the collar. This embodiment may also be employed as a retrofit device for existing funnels.

The self-supporting funnel assembly may also be combined with a drip catcher. A preferred embodiment includes a container with an resealable opening dimensioned and configured to accept the clamping members, whereby clean motor fluid being caught as drips from the funnel may be kept clean. The container may be mounted by various means to a wall or other surface.

Accordingly, it is a principal object of the invention to provide a self-supporting funnel assembly for use in applications in which a user desires to free both the user's hands from holding the funnel in position.

It is another object of the invention to provide a self-supporting funnel assembly which prevents spillage of the funnelled fluid during and after use and a drip catcher for use in combination with the self-supporting funnel assembly.

It is a further object of the invention to provide a self-supporting funnel assembly that may be retrofitted to existing funnels.

Still another object of the invention is to provide a self-supporting funnel assembly which may be securely seated in an opening to allow positioning of the spout over an opening, regardless of a variable horizontal orientation of the opening.

These and other objects of the present invention will become readily apparent upon further review of the following specification and drawings.

BRIEF DESCRIPTION OF THE DRAWINGS

FIG. 1 is a partial cross sectional view of the self-supporting funnel assembly in place on an engine crankcase fill port as.

Similar reference characters denote corresponding features consistently throughout the attached drawings.

DETAILED DESCRIPTION OF THE PREFERRED EMBODIMENTS

The present invention relates to a self-supporting funnel assembly and drip catcher for selective use in applications in which a user desires to free both the user's hands from holding the funnel in position while in use and desires to prevent spillage of the funnelled fluid during and after use.

Figure 1:
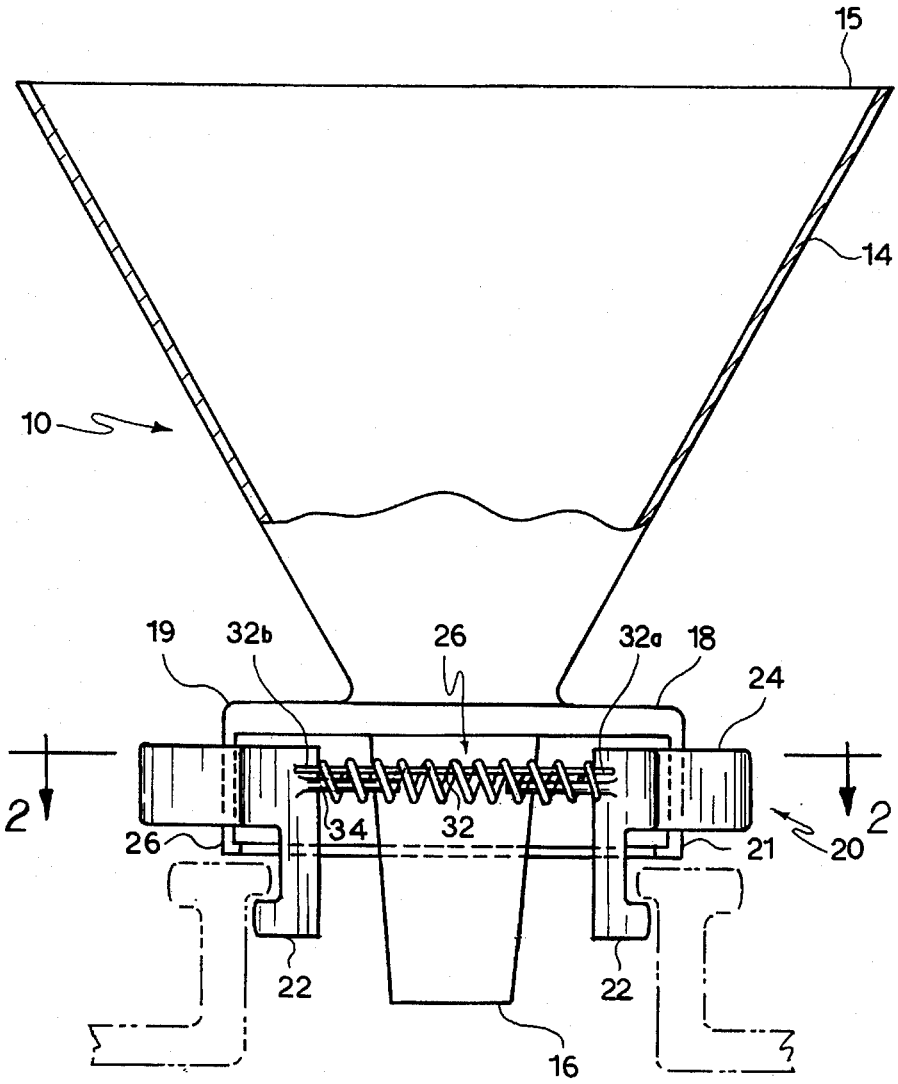
Figure 2:
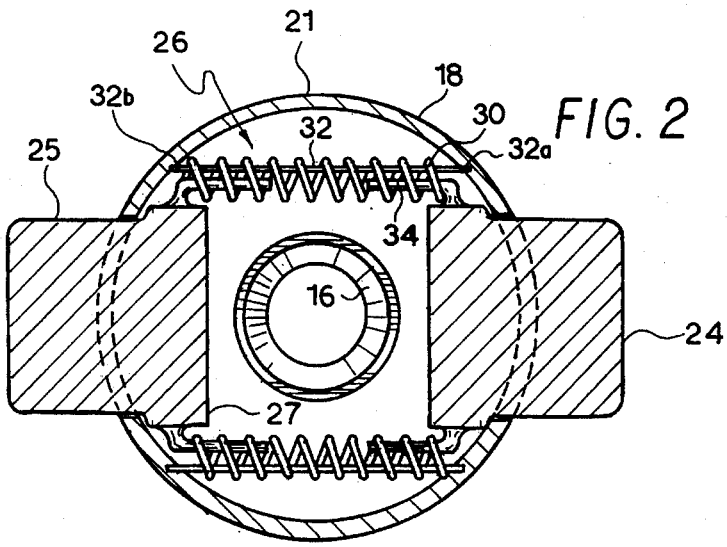
FIG. 2 is a cross sectional view of the self-supporting funnel assembly as drawn on line 2—2 of FIG. 1.

Referring to FIG. 1., the self-supporting funnel assembly 10 is shown in position over an motor engine crankcase fill port P. The self-supporting funnel assembly 10 is intended to accept fluids poured into a wider conical portion or body 14, having a mouth 15 of the funnel at its upper end and a narrower portion 16, defining a spout of the funnel at its lower end. To the narrower portion 16, a base member or housing 18 is affixed, which may be integrally molded into the spout at its lower end. A horizontal plate or ceiling 19 and wall 21 extending downward from the periphery of ceiling 19 form base housing 18. Wall 21 defines several openings or windows though which generally L-shaped clamping members 20 project. Each clamping member 20 has a vertical component 22, and a horizontal component 24. Horizontal component 24 includes a narrow first end 25 projecting horizontally through an opening in wall 21 and a wide second end 27 dimensioned and configured to prevent passage through the opening in wall 21. A springing mechanism 26, operably connects each clamping member to the base housing 18. The base housing 18 may be further configured to be cylindrical and adapted to fit onto common engine fill ports so that a supporting surface 26 of the base housing 18 rests upon the neck of the fill port P. It should be understood that the base housing can be variously shaped, such as having a lip or other additional supportive structure extending from the supporting surface Referring to FIG. 2, the clamping members 20 are shown in their fully open position. In contrast and referring to FIG. 1, the vertical component 22 is shown in contact with the inner surface of the fill port P, wherein the springing mechanism 26 is in a slightly compressed state. As can be appreciated from both FIG. 1 and FIG. 2, the horizontal component 24 appears through the side of the base housing 18 as push-buttons. These push-buttons allow a user to simultaneously compress with the thumb and forefinger the springing mechanism 26 to bring the clamping members 20 into close relationship to one another temporarily. The cylindrical wall of the base housing 18 is dimensioned and configured to permanently retain the springing mechanism 26 and allow the horizontal component 24 to ride inwardly within the housing base 18. The clamping members 20 may thus be inserted into a fill port P as shown in FIG. 1 or other opening, such as a drip-catcher container 2S as shown in FIG. 6.

Figure 3:
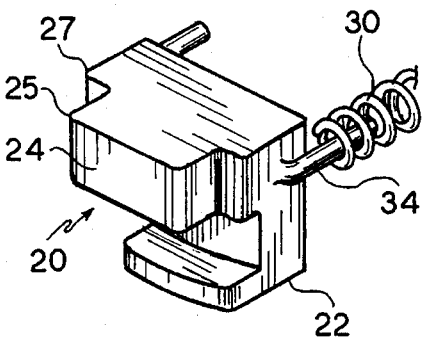
FIG. 3 is an isometric and isolated view of the clamping member and springing mechanism as shown in FIGS. 1 and 2.

The preferred springing mechanism 26 is shown made up of an elongated and generally cylindrically-shaped coiled spring 30 and a support rail 32. The support rail 32 can be seen having a first end **32*a* and a second end 32*b*, each such end being affixed to the wall of the base housing 18. The support rail 32 is located within the length and confines the spring 30 so that the spring 30 remains permanently but slidably secured within the base housing 18. Each of the clamping members 20 are set in opposition of each other and attached to the springing mechanism 26 by means of a tab 34 extending from the horizontal component 16 of each clamping member 20. As can be best appreciated from FIG. 3, the tab 34 engages one of the two terminal ends of the spring 30. Thus, when the horizontal component 24 of the clamping member 20, which extends through the opening in the base housing to appear externally as a push-button, is compressed, the tab 34** transmits the compressive force to the spring.

Figure 5:
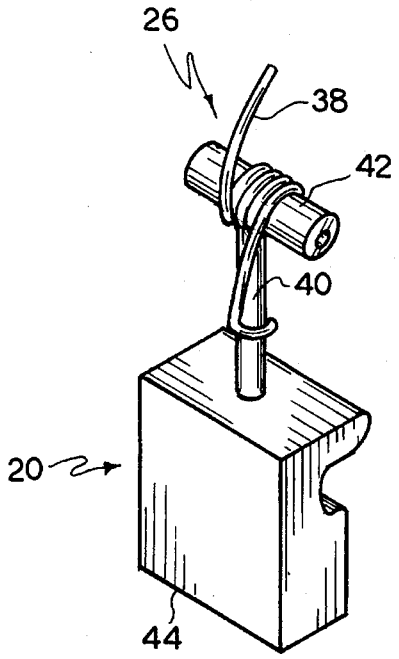
FIG. 5 is an isometric and isolated view of the clamping member and springing mechanism as shown in FIG. 4.
Figure 4:
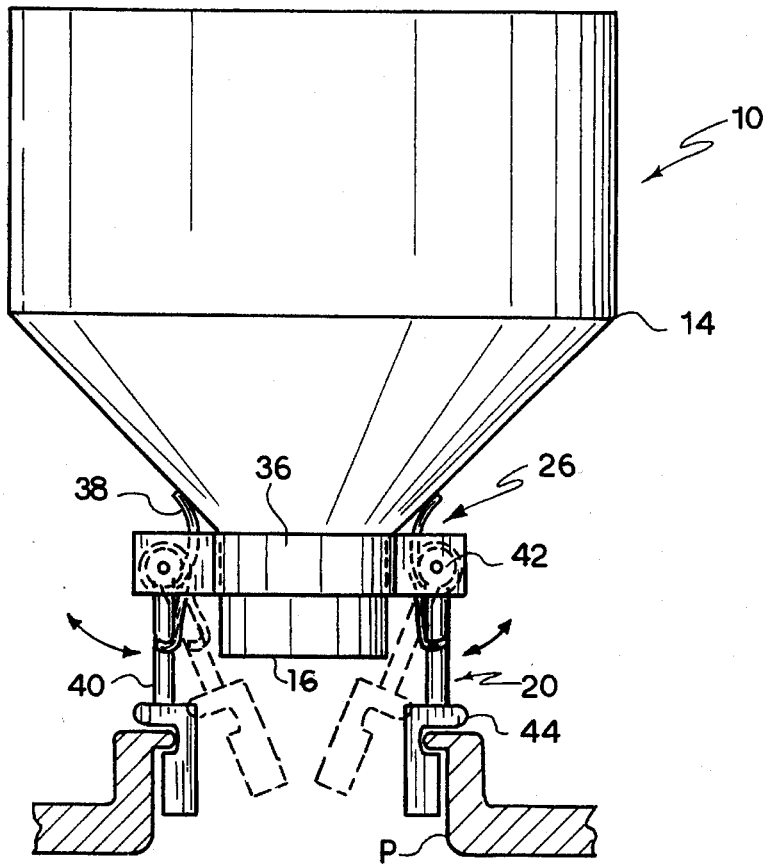
FIG. 4 is an elevational view of a second embodiment of the self-supporting funnel assembly.

Referring to FIG. 5, a second embodiment of the self-supporting funnel assembly 10 is shown with an externally configured springing mechanism 26 and collar 36 from which the clamping members 20 depend. The second embodiment may be employed as a retrofit device 42 for existing funnels F as shown in FIG. 6. The second embodiment employs an a torsion spring 38 as the springing mechanism, which allows an predetermined angle of extension of the clamping member 20 from the collar 36, as represented by the arrows and broken-line illustration of the clamping members. As isolated in FIG. 4, the clamping member is further made up of an arm 40, having a trunnion 42 for pivotal attachment to said collar 36, and a hand 44, which may be dimensioned and configured to provide a gripping surface appropriate to the funnel's intended use.

Figure 6:
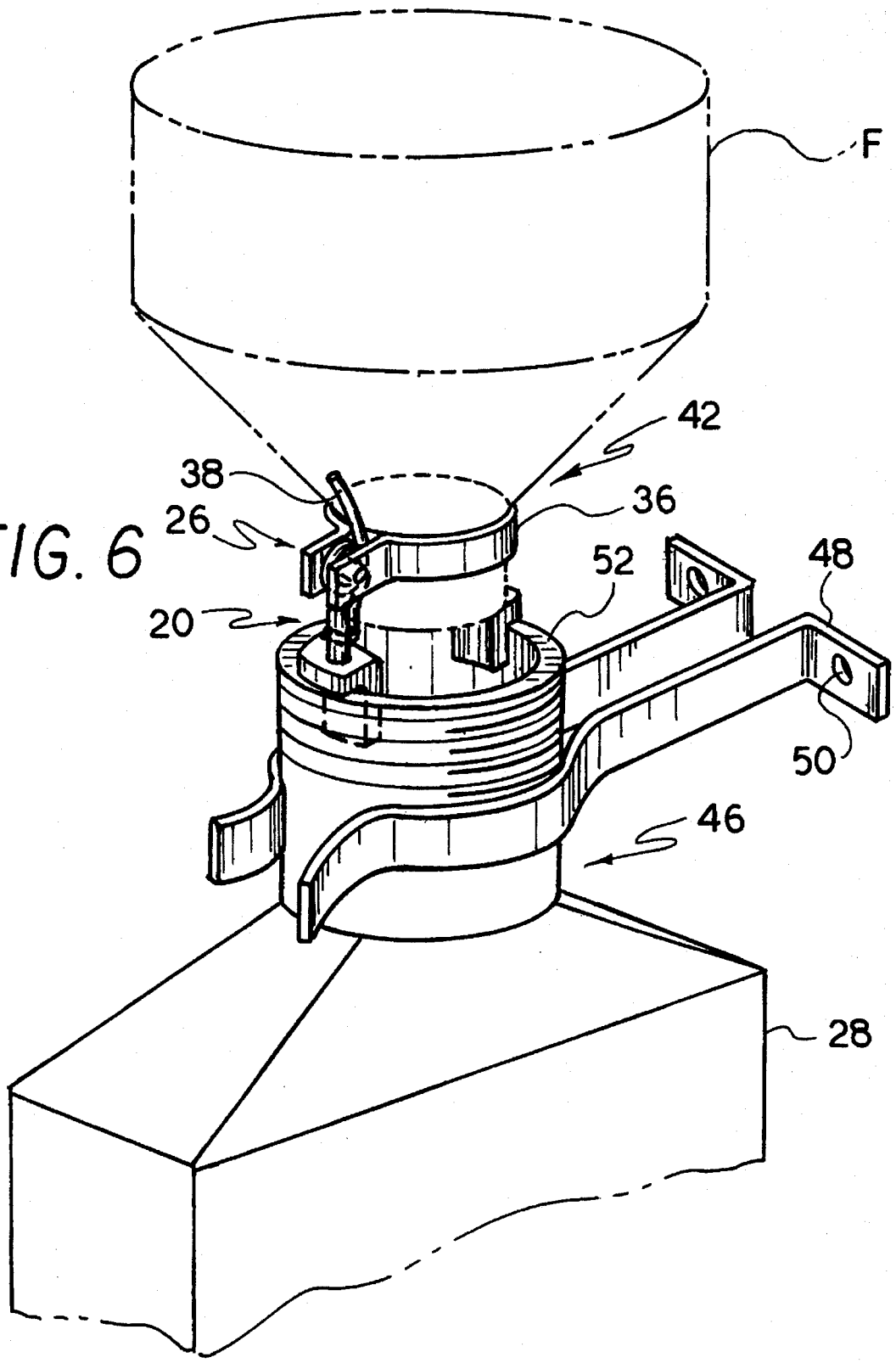
FIG. 6 is an environmental view of the second embodiment of the self-supporting funnel assembly and shown in FIG. 4 stored on a catcher assembly.

As shown in FIG. 6, the self-supporting funnel assembly allows a funnel F to be self-supporting in a drip catcher 46. A preferred embodiment includes a container 28 mounted in a pair of tongs 48 which enable the container 28 to be removably secured. The tongs are adapted so that they can be mounted on a plate or directly on a wall surface by means of a fastener through a bore 50 in the tongs. The container 28 has a resealable opening 52, whereby clean motor fluid being caught as drips from the self-supporting funnel assembly may be kept clean, the opening 52 being further adapted to accept the clamping members 20.

It is to be understood that the present invention is not limited to the embodiments described above, but encompasses any and all embodiments within the scope of the following claims.

I claim:

1. A self-supporting funnel assembly comprising:

a generally conical body having a wide mouth at an upper end and a narrow spout at a lower end;

a base member attached to said narrow spout;

two opposed clamping members supported by said base member; and at least one spring disposed between said clamping member for biasing said clamping members apart.

2. The self-supporting funnel assembly according to claim 1, wherein each of said clamping members is comprised of a horizontal component and a vertical component forming a generally L-shaped configuration.

3. The self-supporting funnel assembly according to claim 1, further comprising at least one support rail having a first end and a second end affixed to said base member, wherein said at least one sping includes a generally cylindical coiled sping having said support rail passing therethrough.

4. The self-supporting funnel assembly according to claim 3, further comprising a tab affixed to each of said clamping members for engaging said at least one spring, whereby each of said clamping members is able to move inwardly upon application of an external force and resiliently return to its original position.

5. The self-supporting funnel assembly according to claim 1, wherin each of said clamping members has an upper end, a lower end, and at least one lip perpendicularly affixed to said lower end for extending below and engaging an edge of an opening.

6. The self-supporting funnel assembly according to claim 1 wherein said base member includes a plate extending from said narrow spout and a wall, said plate having a periphery, said wall depending from said periphery of said plate, said wall having two opposing windows passing therethrough and wherein each of said clamping members includes a horizontal component having a narrow first end extending through one of said windows and said horizontal component further having a wide second end confined within said wall.

7. The self-supporting funnel assembly according to claim 6, wherein each of said clamping members further includes a vertical component intergrally afixed to said wide second end, said vertical component extending below said wall.

* * * * *